US006237517B1

(12) United States Patent
Bondanza et al.

(10) Patent No.: US 6,237,517 B1
(45) Date of Patent: May 29, 2001

(54) QUILT PANEL CUTTER WITH QUILTING SYSTEM BATCH AND PANEL LENGTH CONTROL

(75) Inventors: James Bondanza, Tamarac; M. Burl White, Coral Springs, both of FL (US)

(73) Assignee: Ormco Corporation, Orange, CA (US)

( * ) Notice: Subject to any disclaimer, the term of this patent is extended or adjusted under 35 U.S.C. 154(b) by 0 days.

(21) Appl. No.: 09/359,535

(22) Filed: Jul. 22, 1999

(51) Int. Cl.[7] ..... D05B 11/00

(52) U.S. Cl. ..... 112/118; 112/130; 112/470.04; 112/470.05; 112/475.08

(58) Field of Search ..... 112/117, 118, 112/119, 305, 307, 314, 315, 470.03, 475.02, 475.01, 470.04, 470.05, 470.31, 470.32, 475.08, 130; 226/24

(56) References Cited

U.S. PATENT DOCUMENTS

| | | | |
|---|---|---|---|
| 3,867,889 | 2/1975 | Conner, Jr. . | |
| 3,960,095 | 6/1976 | Story . | |
| 4,037,546 | 7/1977 | Kleinschmidt . | |
| 4,785,750 | 11/1988 | Best . | |
| 4,815,405 | 3/1989 | Young, Jr. . | |
| 5,018,416 | 5/1991 | Freermann . | |
| 5,154,130 | 10/1992 | Gribetz et al. . | |
| 5,544,599 | 8/1996 | Frazer et al. . | |
| 5,603,270 * | 2/1997 | White et al. | 112/117 |
| 6,026,756 * | 2/2000 | Frazer et al. | 112/118 |

* cited by examiner

*Primary Examiner*—Peter Nerbun
(74) *Attorney, Agent, or Firm*—Wood, Herron & Evans, L.L.P.

(57) ABSTRACT

A quilting system that includes a multiple needle quilting machine is provided with batch processing capability by the addition of a panel cutter in-line with and downstream of the quilting machine. The panel cutter is equipped with a programmed controller that is loaded with batch information for the production, on the quilting machine, of a plurality of quilts by stitching patterns on a multilayered web of fabric. The batch information includes information of a number of quilts to be quilted as well as the patterns to be quilted on each quilt and the composition of the material on which the patterns are to be quilted. Information is derived by the panel cutter controller from sensors on the panel cutter, which information is used to control the quilting machine by adjusting the length of quilted material from the quilter. The panel cutter controller may also operate the quilter to adjust for shrinkage in web length caused by the quilting, and to synchronize splices in the web between different material layer combinations for different quilts of the series to be quilted.

19 Claims, 1 Drawing Sheet

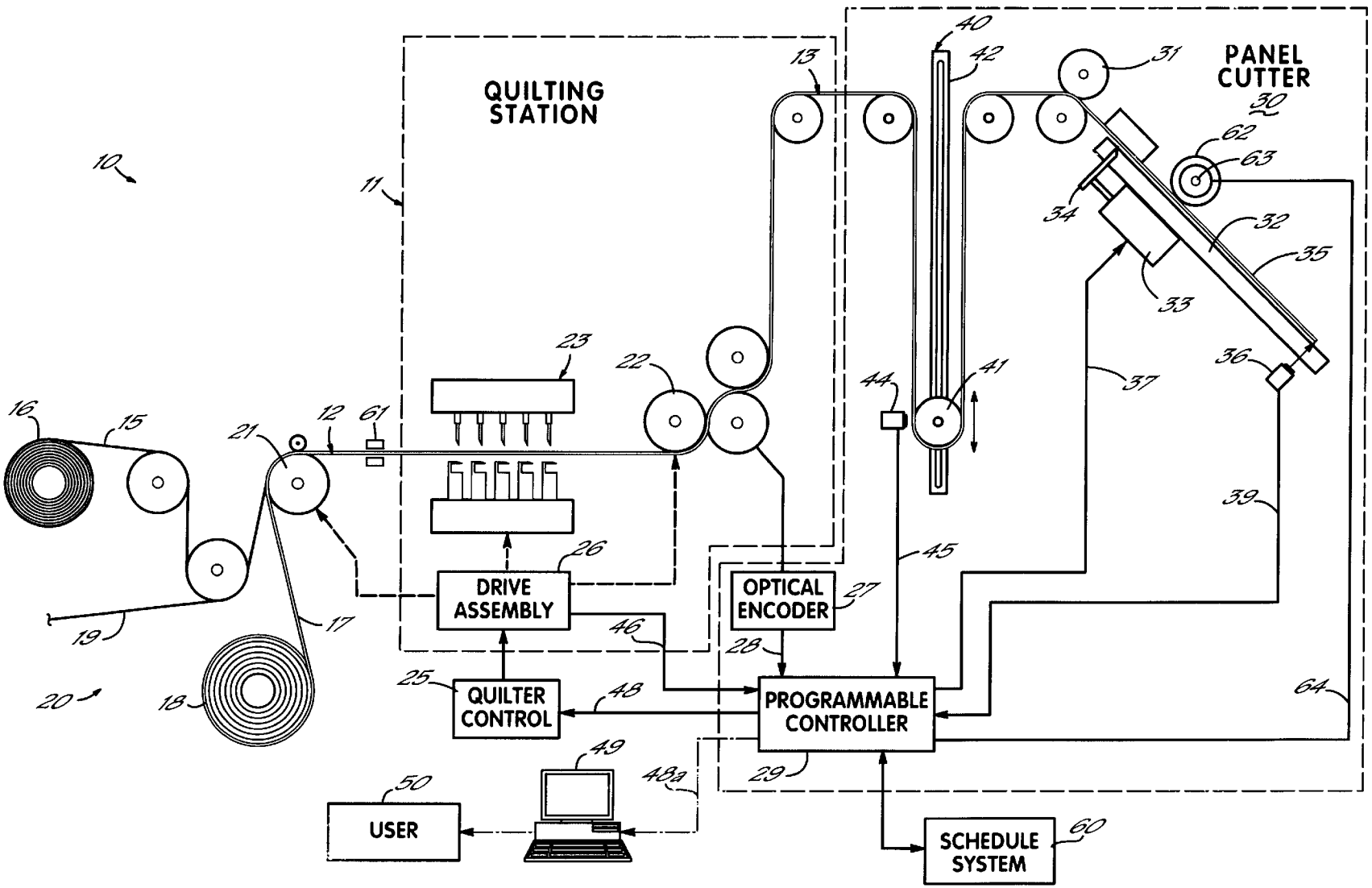
PANEL CUTTER
QUILTING STATION
OPTICAL ENCODER
PROGRAMMABLE CONTROLLER
SCHEDULE SYSTEM
DRIVE ASSEMBLY
QUILTER CONTROL
USER

QUILT PANEL CUTTER WITH QUILTING SYSTEM BATCH AND PANEL LENGTH CONTROL

The present invention relates to quilting, and particularly to methods and machines for producing a series of quilted panels and controlling the feed between fabric-quilting operations and panel-cutting operations of quilted panels formed from multiple layered fabric webs.

BACKGROUND OF THE INVENTION

In large scale multiple needle quilting machines, several layers of fabric web are brought together at a quilting station where they are sewn together by the stitching of patterns thereon. The patterns are formed by moving the composite multiple layered fabric web relative to a bank of stitching elements that include an array of needles above the fabric and a corresponding array of loopers or other cooperating stitching elements below the fabric supported on a needle plate. The relative motion of the fabric and the stitching elements is often carried out under the control of a cam driven mechanical or electronically programmable controller. The programs of the controllers are varied in order to produce a variety of patterns to satisfy the requirements of the customers of the quilted fabrics. These customers are often the manufacturers of mattresses and other upholstered items, whose requirements are varied. Such customers of a quilt manufacturer may each order a number of different patterns in small or moderate quantities, requiring the quilt manufacturer to frequently change the pattern program and possibly also the fabric material.

When quilts are stitched on multi-needle web fed quilting machines, a series of a panel-length sections of quilted patterns emerge from a downstream end of the quilting station of the quilting machine as part of a single continuous web. The series might include multiple copies of the same pattern sewn on the same material, a series of different patterns sewn on the same material, or a series of the same or different patterns sewn on different types of material spliced together to form the continuous web. The series of panels quilted on the web are then severed into finished quilted panel lengths, often on a panel cutter situated either downstream of the quilting machine and through which the quilted web is fed or off line into which a quilted web must be fed after being quilted and then folded or rolled. In many quilt making facilities, quilting machines operate independently of the panel cutters and the coordination between the quilting and panel cutting operations is manually controlled.

To automate production of various types of panels or batches of panels, quilting machines have been provided such as that disclosed in U.S. Pat. No. 5,154,130 entitled "Multi-Needle Double Lock Chain Stitch Tack, Jump and Thread Trimming Quilting Method and Apparatus", which is assigned to the assignee of the present application and is hereby expressly incorporated by reference herein. Such quilting machines include controllers programmed to cause movement of fabric relative to the stitching elements to produce the various patterns and to change from pattern to pattern in accordance with different jobs of a production schedule. Such machines may also signal the need to change and splice materials where called for by an order description.

Each of the panel length sections of quilted web that emerge from the quilting station must ultimately be cut from the web to form individual quilted panels. This has often been achieved by placing in line with and downstream of the quilting station a panel cutter that includes a transverse knife or blade that is intermittently actuated to cut transversely across the quilted fabric to separate the individual panels from the web. The quilting of patterns onto a web and the cutting of discrete panels from the web requires coordination of the panel cutter knife and the quilting station as well as the location of the splices in the fabric. This coordination has been carried out either with manual monitoring by an operator and manual decision making or by an automated quilting and panel cutting machine such as that disclosed in U.S. Pat. No. 5,544,599 entitled "Program Controlled Quilter and Panel Cutter System with Automatic Shrinkage Compensation", assigned to the assignee of the present application, hereby expressly incorporated by reference herein.

The coordination of a panel cutting operation with a stitching operation and the splicing of material in a web that is being formed into a series of quilted patterns is complicated by the phenomenon referred to in the quilting industry as "shrinkage". Shrinkage of the fabric is a result of the stitching together of multiple layers of fabric that include the top and bottom layers with a filler layer in between. As the layers are stitched together, the material tends to gather, causing the fabric to shorten dimensionally in the longitudinal direction along the web. The longitudinal shrinkage is the primary complicating factor in coordinating the operations on the web. The amount of shrinkage varies among different patterns, due to the different amounts and configurations of the stitching called for by the patterns. Fabric is under tension in the quilting machine has its longitudinal dimensions affected slightly but materially by shrinkage, but when tension is released, shrinkage is manifested in a greater shortening of the fabric. Shortening may vary without a change in the patterns or the material due to ambient factors such as humidity in the plant.

The dimensions of the cut unstressed panels are the dimensions to which the quilting, splicing and feeding of the web must be coordinated, since these are the specified dimensions of the finished product. In order to produce a panel of a given length, a section of the web of a somewhat greater length must be quilted, and the position and dimensions of the quilted patterns on the web must be adjusted to accommodate for the shrinkage that will occur. In addition, due to the shrinkage, the rate of feed of web through the quilting station and through the panel cutter will differ. This shrinkage compensation is accounted for manually by an operator of mechanical and stand-alone quilting machines by timing the ON and OFF functions of the quilter or by adjusting the longitudinal scale of the pattern. The system described in U.S. Pat. No. 5,544,599 coordinates the quilting operations and panel cutting operations of an integral quilter and panel cutter system while adjusting the stitching and web feed to the quilting station so as to compensate for such shrinkage so as to deliver specified panel lengths to the panel cutter.

Cumulative effects of shrinkage are taken into account either manually or automatically by the system described above to minimize waste when different materials must be spliced together and to synchronize the cutting of panels precisely between the patterns.

A variety of quilting machines are being used in quilt manufacturing, including web fed quilters of types used to quilt mattress covers from web fed material. Many of these machines are either manually controlled or are necessarily provided without integral panel cutters. As a result, the addition of panel cutting operations to the quilting line brings with it the need to manually coordinate the quilting and panel cutting operations in a way that deals with the problems discussed above. As a result, the quilt making process is undesirably operator intensive and system throughput is limited by the frequent operator intervention.

Accordingly, there is a need to accommodate the variety of quilting machines being used in quilt manufacturing industry, particularly web fed quilters used for mattress cover manufacturing as well as other types of quilters used for other quilted products where trimming or panel cutting or other series operations must be performed on the material. Such need includes the need to synchronize machines that have been manually controlled or do not include integral panel cutter controlled operation. There is a particular need to coordinate the quilting and panel cutting operations when panel cutters are supplied in line with stand-alone quilters and other quilters that do not have shrinkage compensation or panel cutter coordination capability. There is a further need to generally make the quilt making process less operator intensive and to make system throughput less limited by the operator intervention.

SUMMARY OF THE INVENTION

A primary objective of the present invention is to provide panel-cutter for use in-line with a quilting machine for cutting panels of quilted material from a web while providing control information for controlling the length of quilted material being quilted by the quilting machine. Another object of the present invention is to provide a panel cutter capable of providing batch mode control to quilting machine.

A further object of the present invention is to provide a panel cutter that can accommodate a variety of quilting machines, and particularly web fed quilters, that provides for the synchronizing of length of fabric quilted by the quilting machine to that cut by the panel cutter. Particular objects of the invention are to provide a panel cutter that is equipped to determine and inform a quilting machine operator of the parameters and settings necessary to manually control a manual quilting machine or to automatically control the operation of a quilting machine having controls that are not otherwise integrated to those of a panel cutter.

Additional objectives of the present invention are to coordinate the quilting and panel cutting operations to provide shrinkage compensation when panel cutters are supplied in line with stand-alone quilters and other quilters that do not have shrinkage compensation or panel cutter coordination capability, and to make the quilt making process less operator intensive and the quilting system throughput less limited by the operator intervention.

According to principles of the present invention, there is provided a panel cutter having a programmed control that communicates information to the controller or operator of a quilting machine for control of the lineal production of the quilting machine in coordination with the operation of the panel cutter. According to further principles of the invention, a quilt panel cutter is provided that has the capability of controlling, or communicating information for controlling, a quilting machine when connected upstream of the panel cutter, to operate in coordination with the panel cutter, particularly to produce a sequence of quilted panels in batches, for example, in accordance with a plurality of customer orders.

According to the preferred embodiment of the invention, a panel cutter is provided having a programmed controller that has a control output that connects to a quilting machine from which a web of quilted fabric produced by the machine is fed to the panel cutter and which supplies signals to the quilting machine to control the lineal rate of production of quilted material in coordination with the lengths of panels being cut. The programmed control of the panel cutter operates the quilting machine through the production of a series of quilted panels, preferably in accordance with batch order information input to the panel cutter controller. The panel cutter controller may input the signals directly to a controller of the quilting machine to start, stop or control the speed of the quilting operation or may provide information to a management system computer or to a quilting machine operator which, in turn, affects the control of the quilting machine. The control of the quilting machine by the panel cutter matches the output of the quilting machine to the input of the panel cutter, and preferably further adjusts the quilted material length to compensate for longitudinal shrinkage resulting from the quilting operation.

In accordance with preferred embodiments of the invention, a panel cutter is combined with a quilting machine upstream of the panel cutter and the combination is controlled to compensate for shrinkage by repeatedly measuring and re-estimating the amount of shortening in longitudinal dimension along a web that occurs as the web is quilted under tension and after tension is removed from the quilting machine. The control is programmed to control the amount of material that must be quilted to make up for the material removed from the downstream end of the web by a panel cutter. Preferably also, the controller calculates the positions of quilted patterns, material splices and other features along the web as the moving web changes dimensionally, and controls the movement of the web through the quilting machine and the positioning of the patterns on the web by the quilting machine.

In its preferred embodiment, the quilting machine of the present invention includes a multiple needle quilting station at which multiple layered fabric is quilted, preferably by chain stitching. An accumulator station is also provided at the upstream end of the panel cutter to provide some form of web accumulation. The accumulator station may take the form of a dancer type roll that rests on top of the web and rides up and down in a track.

The control of the quilting machine by the panel cutter preferably makes use of one or more sensors for measuring the lineal rate of feed of material into and out of the quilting station.

The quilt is under tension between the quilter and the feed rollers of the cutter. This fabric particularly shrinks as tension is relaxed as the fabric passes input feed rollers at the inlet side of the cutter. Therefore, one or more sensors in the panel cutter inform the controller that a fixed length of unstressed, and therefore shrunken, quilt has been cut from the web.

The control system of the preferred embodiment of the invention preferably is provided with one or more digital encoders mounted on the shafts of one or more rollers at the upstream and/or downstream ends of the quilter to accurately measure the running length of quilted web passing through the nips of the rollers. The encoders preferably generate series of digital pulses, each of which, when communicated to the controller, informs the controller that a fixed incremental length of fabric has been fed into and/or out of the quilting station of the quilting machine. In addition, the limit switches or other types of position detectors located at the accumulator roll or at the input or output of the panel cutter also signal the controller of panel length information used to control the quilter.

The present invention keeps the length of material through the quilter and cutter flowing at the appropriate and coordinated rates and achieves proper location of the patterns on the panels and the proper lengths of quilted panels, and, in addition, keeps track of the locations of splices and pattern changes in the quilted material as small orders or batches of orders of different quilted products are sequentially produced by the computerized pattern control of the quilter.

These and other objectives and advantages of the present invention will be more readily apparent from the following detailed description of the drawings of the preferred embodiment of the invention, in which:

BRIEF DESCRIPTION OF THE DRAWINGS

The FIGURE is a diagram illustrating a panel cutter embodying principles of the present invention in combination with a quilting machine which it controls.

DETAILED DESCRIPTION OF THE DRAWINGS

The FIGURE diagrammatically illustrates a large scale quilting line 10 that includes a quilting machine 11, a supply 20 of material for forming a multi-layered web of fabric 12 directed into the quilting machine 11, and a panel cutter 30 located downstream of the quilting machine 11 such that the web 13 of material quilted by the machine 11 is directed into the panel cutter 30. The quilting machine 11 of such a quilting line 10 can be any one of a number of commercially available quilting machines, preferably of the multi-needle and chain stitch type. Such quilting machines 11 are preferably capable of quilting patterns onto a web under a mechanical or electronic control, preferably programmable to provide selection of any of several patterns. The quilting machine 11 can be manually controlled with its operation started, stopped, or varied by commands input by an operator or can be operated by a controller or otherwise in response to signals from a controller or computer to start, stop or vary the quilting machine operation.

The quilting machine 11 at which stitched patterns are applied to the multiple layered web of fabric 12 to form the quilted web 13. The multiple layered web of fabric 12 is formed by combining a web of top goods 15 from a top goods supply roll 16, a web of backing 17 from a backing material supply roll 18, and a web of filler 19 interposed between the backing and top goods webs at the upstream end 20 of the quilting machine 11. The quilting machine 11 may, for example, have front and back sets of transversely extending, transversely shiftable, reversible rollers 21 and 22, respectively, to engage and move the web 12 relative to a stitching mechanism 23 at the quilting machine 11. Of the rollers 21 and 22, the outlet side or downstream rollers 22 are typically the primary feed rollers of the quilting machine 11 that maintain tension on the web 12 between the rollers 21 and 22. The feed rollers manipulate the web 12 longitudinally relative to the stitching mechanism 23 to define the stitched pattern being applied to the web 12, and control the overall advance or downstream feed of the quilted web 13.

Downstream of the quilter 11, the panel cutter 30 has, at the upstream end thereof, a set of web feed elements 31, which engage the quilted web 13 being fed from the quilting machine 11 and advance it onto a downwardly inclined table 32. The feed elements 31 are preferably in the form of a pair of opposed feed rollers which engage the quilted web 13 and maintain tension on the quilted web 13 on the upstream side of the elements 31. The panel cutter 30 further includes a cutoff mechanism 33, which includes a transverse blade or knife 34, which is operable, upon receipt of a cutoff signal from the controller 29 along line 37, to transversely sever the portion of the downstream end of the quilted web 13 that extends beyond the knife 34 from the upstream portion of the web 13, thereby forming a quilted panel 35.

At the lower end of the table 32 is a sensor 36 operable to detect the presence of quilted fabric. The sensor 36 may be, for example, a photodetector that will generate a signal at the instant that the leading edge of the quilted web 13, fed by the feed elements 31, extends sufficiently beyond the knife blade 34 of the cutoff mechanism 33 and down the inclined surface of the table 32 to reach the sensor 36. When this leading edge is detected by the sensor 36, a signal is communicated along input line 39 to the controller 29.

At the upstream end of the panel cutter 30 is provided an accumulator section 40 which accumulates quilted web 13 fed from the outlet side feed rollers 22 of the machine 11 and supplies quilted web 13 to the feed elements 31 of the panel cutter 30. The accumulator section 40 also resupplies web 13 to the feed rollers 22 when the feed of the web 13 is reversed in the course of complex pattern sewing. The accumulator section 40 includes an accumulator roll 41 that extends transverse of the quilted web 13 and generally is supported by the web 13. The weight of the roll 31, which may be in the order of approximately one hundred pounds, for example, is supported by both the upstream and downstream extensions of the web 13 on both sides of the roll 41, thereby establishing and maintaining a generally uniform tension on the web 13. The accumulator section 40 includes a generally vertical track 42 in which the roll 41 moves, either up or down, whenever the rate that the web 13 is being fed downstream from the feed rollers 22 differs from the rate that the web 13 is being fed downstream by the feed elements 31. Specifically, when the feed rate from the feed rollers 22 exceeds the feed rate at the feed elements 31, the roll 41 moves down to take up the excess from the feed elements 22. When the feed rate from the feed elements 31 exceeds the feed rate from the rollers 22, the roll 41 moves up to supply the difference to the feed elements 31.

At the bottom of the track 42 is a limit switch 44, or other suitable roll position detector, which generates a signal along an input line 45 to the controller 29, signaling that the accumulator 40 is at its maximum capacity. A similar switch (not shown) may be provided at the top of the track 42 to signal that the accumulator is at its minimum capacity. Information relating to the net amount of web 13 being fed to the accumulator 40 by the feed rollers 22 is received by the controller 29 from the encoder 27. Information relating to the amount of web 13 fed by the feed elements 31 is recorded as one panel length every time a signal is received from the sensor 36. One panel length is equal to the distance of the sensor 36 from the knife blade 34 on the panel cutter 30.

The panel cutter controller 29 is programmed to respond to a signal from the accumulator maximum capacity switch 44 and, in response thereto, activate the feed elements 31 to feed web 13 from the accumulator 40 onto and down the table 32. In certain embodiments of the invention where the quilter 11 is one that is responsive to automated control, the panel cutter controller 29 is also programmed to send a signal to the quilter control 25 in response to which the quilter control 25 can control the quilter drive 26 to stop or slow the operation of the quilter 11 so that web 13 is not fed to the accumulator 40 by the feed rollers 22 faster than it is fed from the accumulator 40 by the feed elements 31. Further, the controller 29 is also programmed to send a signal to the quilter control 25 to control the quilter drive 26 so as to start or speed up the quilter 11 when additional quilted web 13 is required by the panel cutter 30. In other embodiments of the invention, the controller 29 communicates quilter control information along line 48*a* to cause the display on terminal 49 of the information in operator readable form. In response to the displayed information a machine operator 50 can manually operate the quilter 11 by entering commands through the quilter control 25 to start, stop or vary the speed of the quilter 11.

Attached to the shaft of one of the feed rollers 22 is, according to certain embodiments of the invention, a digital optical encoder 27, or other type of measuring instrument, for measuring the linear feed of the web 13 through the nip of the rollers 22. The drive assembly 26 of the quilting machine 11 preferably also includes a measuring device to output a signal on a line 46 that is representative of the feed of the material web 12 into the quilter 11. Preferably, the measuring instruments, such as the digital optical encoder 27, generate series of digital pulses, for example as the rollers 22 rotate, each pulse corresponding to a fixed length of incremental feed of the web 12 or 13 over the rollers 21 or 22. The encoder 27 has an output 28 through which the pulses are transmitted to an input of the programmable controller 29 of the panel cutter 30. The output 46 of the drive control 26 is also connected to an input of the controller 29 of the panel cutter 30. The controller 29 is preferably a microprocessor based digitally programmable industrial controller or general or special purpose digital computer. The controller 29 contains a counter, which may be a specially programmed section of memory connected to the controller processor, that counts pulses from the encoder 27 and therefrom calculates the amount of web 13 fed downstream from the quilting station 11. Because in the course of quilting the web may be longitudinally reversed several times through the quilting machine 11 in order to sew 360° or other complex patterns, the pulses from the encoder are direction sensitive so that an algebraic count can be made by the counter of the controller 29 to accurately measure the net feed of the quilted web 13 beyond the feed rollers 22.

The overall operation of the quilter 11, including the compensation for longitudinal shrinkage of the panels, is controlled in response to information from the controller 29 which sends control signals to the drive 26 of the quilter 11 either directly through line 48, where the quilter is so equipped, or via an operator 50 through line 48*a* and terminal 49. The information from the controller 29 is used to operate the quilter 11 to move an increased amount of the web 12 and to move it an increased distance relative to the stitching mechanism 23 as is necessary to compensate for panel shrinkage as calculated by the controller 29 of the panel cutter 30.

In operation, multiple layered fabric 12 is quilted to form the quilted web 13 at the quilting station 11 of the quilting machine 10. In the process, the stitching sewn by the stitching mechanism tends to shorten the longitudinal dimension or length of the fabric due to the gathering of the material during quilting. This shortening is resisted by whatever tension is maintained in the longitudinal direction on the web 13. Such tension is typically proportional to the weight of the accumulator roll 41 of the accumulator section 40. The shortening has the effect of imparting a degree of apparent elasticity to the quilted web 13. The quilted web 13 leaves the quilting station 11, passing through the feed rollers 22 under this maintained tension. The digital encoder 27 on the shaft of one of the feed rollers 22 accurately measures the running length of quilted web 13 that passes through the nip of the feed rollers 22.

From the feed rollers 22, the quilted web 13 passes downstream to the accumulator 40 at which the roll 41 rests on top of the web 13 and rides down in the track 42. The feed elements 31 on the panel cutter 30 are at this time inactive, so none of the web 13 is being fed from the accumulator 40 to the panel cutter 30. When the roll 41 of the accumulator 40 reaches the bottom of the track 42 as the web 13 fed from the rollers 22 fills the accumulator 40, the switch 44 is activated, which generates a signal to the controller 29 indicating that the accumulator 40 is full. In response to this signal, the controller 29 generates the information in response to which the drive assembly 26 activates the feed elements 31 to feed web 13 out of the downstream end of the accumulator 40 and down the table 32. Preferably, simultaneous with the activation of the feed elements 31, the controller 29 stores the count of the pulses from the encoder 27 and resets its counter to restart the counting of the pulses from the encoder 27.

The feed elements 31 of the panel cutter 30 operate to advance the quilted web 13, which is under tension on the upstream side of the elements 31, onto a downwardly inclined surface of the table 32, where the only tension on the web 13 is weight of the quilted fabric itself. With this reduction of tension, the web longitudinally shortens or shrinks. The feed elements 31 continue to feed the web 13 onto the table 32 until the leading edge of the web 13 is optically detected by the photoelectric detector or eye 36. At this point, the detector 36 generates a signal that is communicated to the controller 29, in response to which the controller stops the feed rolls 31 and sends a cutoff control signal to the cutting mechanism 33 to activate the knife blade 34 to transversely sever a panel at which point a transverse knife is actuated at the top of the inclined surface to cut a panel from the leading end of the web that is of a precise length equal to the distance from the photodetector 36 to the knife blade 34.

Since the quilted web 13 is under tension between the quilter feed rollers 22 and cutter feed elements 31, and the tension in the web 13 drops almost to zero as the fabric passed the cutter feed elements 31 the top of the inclined surface, the quilt has relaxed or shrunken as it was fed down the inclined surface of the table 32 to the photoelectric detector 36, so that the cut panel has shortened to its unstressed finish panel length. So for 54" knife to sensor spacing, which produces panel length of a 54" finished dimension, a greater length (as for example, 59" or 60" of web 13) is fed from the accumulator 40.

When the knife 34 is activated, the controller simultaneously stops the feed elements 31, thus stopping the feed of quilted web 13 out of the accumulator 40. Then, the next time the switch 44 detects the presence of the accumulator roll 41 at the bottom of the track 42, the count in the counter of the controller 29 will represent the amount of stretched quilted web 13 that had to be fed from the feed rollers 22 to replenish the amount of quilted web 13 fed to the panel cutter 30. The length of this amount of web 13 fed to the accumulator 40 that is in excess of the predetermined length of the cut panel, when divided by the length of the cut panel, equals the shrinkage factor of the panel, which is a fraction of the stretched length of the web 13. Thus, measured by the detector 36, for example, 59 or 60" must be quilted and fed from the quilter 11 for each 54" panel to be produced.

Where shrinkage compensation is provided, the controller 29 preferably predicts shrinkage by repeated measurements. Each time the cutter mechanism 33 is activated and a precise panel length of, for example, 54" is cut from the quilted web 13, the controller 29 records 54" of unstretched quilt as being fed from the accumulator 40, shrunken to the extent that the relaxation of the tension on the fabric. The amount of contraction or shrinkage varies as the quilted patterns are changed by the pattern control program of the controller 29. The shrinkage also varies as factors such as humidity in the plant vary, and due to other factors that cannot be readily predicted.

The shrinkage factor on the quilted fabric that is realized when the tension on the fabric is relaxed is variable and might, for example, average 10 percent. To measure the shrinkage, the program in the controller 29 preferably utilizes the fact that, when the accumulator roll 41 is at its extreme bottom position in its track, a known length of tensioned quilted fabric exists between the feed rollers 22 at the exit of the quilter 11 and the feed elements 31 at the front of the cutter 30. Thus, by activating the cutter feed elements 31 whenever the accumulator roll 41 is at its bottom position to feed one untensioned length of quilt past the cutter blade 34, and then measuring the amount of quilted material fed from the quilter 11 by the quilter feed rollers 22 until the accumulator roll 41 again reaches its bottom position, the exact length of shrinkage can be calculated.

The shrinkage that is calculated is, however, the amount of shrinkage experienced by the last panel length that was cut by the cutter. This is not necessarily the amount of shrinkage to be experienced by the length of the next panel length to be cut, but nonetheless serves as an estimate of that length. In operation, the quilter will usually operate continuously while the panels are being fed and cut. Therefore, the running estimate of shrinkage is constantly being made and corrected as data of the lengths of fabric fed from the quilter and to the cutter are generated. The throughput of the quilter and cutter are thereby coordinated and controlled.

Shrinkage compensation is important not only to keep the length of material through the quilter 11 and cutter 30 flowing at the approximate same rate, but to keep track of the locations of splices and pattern changes in the quilted material as small orders of different products are sequentially produced by the quilter under the control of the computerized pattern control program of the controller 29. The prediction of shrinkage is factored into the pattern control program so that the patterns can, where desired, be centered on a panel of the predetermined finished unstressed shrunken length that it will assume on the table 32 of the panel cutter 30.

The calculated shrinkage is used by the controller 29 to control the amount of feed of web 12 to the quilting station 11, to control the location of the quilted pattern in relation to the web 12, to control stitching mechanism 23 and drive assembly 26 to adjust the elongation or spacing of the quilted patterns so that they occupy the appropriate length or positions on the shrunken cut panels, and to control the feed of the quilted web 13 out of the quilting station 11. The control also uses the shrinkage calculation to either register the patterns on the web in relation to the locations of material splices on the web, or to signal where splices are to be made in the webs of fabric 15, 17 and 19 being fed to the quilter.

Further, the controller 29 of the panel cutter 30 can be loaded with information from an operator or from an automated scheduling system 60 to enable the quilter to produce series of patterns in accordance with production schedules in which the patterns of the series may change from pattern to pattern. One such automated scheduling system is described in the commonly assigned and copending U.S. patent application Ser. No. 09/301,653, U.S. Pat. No. 6,105,520 filed Apr. 28, 1999 entitled Quilt Making Automatic Scheduling System and Method, hereby expressly incorporated herein by reference. This provides the panel cutter 30, according to principles of the present invention, to enable the quilting system 10 to manufacture batches or multiple series of quilts in accordance with a series of customer orders, even though the quilting machine 11 that is used in the quilting system 10 is not itself of a type having the capacity for batch mode processing.

In batch mode processing, batch information is loaded into the controller 29 to define each of a series of quilt products to be made on the quilting line 10. For example, (1) first batch data might specify that five quilts are to be made using a first material combination (of top goods, backing goods and filler layers) quilted with pattern A, then (2) second batch data might specify that eight quilts are to be made using the same first material combination but quilted with pattern B, then (3) third batch data might specify that three quilts are to be made using the a second material combination and quilted with pattern C.

Where the quilter 11 itself cannot process data of multiple batches, the batches of quilts can be made on the system 10 with the controller 29 of the panel cutter 30 running the first batch of five quilts, then stopping the quilting machine 11 as soon as the fifth quilt of the first batch passes from the quilting head 23 and informing the operator 50 on the display 49 that a particular pattern change from pattern A to pattern B must be entered through the quilter control 25. When the operator 50 has changed the pattern, by software changes or hardware setting changes, possibly including needle setting changes, the operator 50 signals that the change is complete and the controller 29 thereupon controls the quilter 11 and panel cutter 30 to quilt patterns of the second batch while panels, including the final panels of the first batch, are being cut from the web 13.

The controller 29 of the panel cutter 30 runs the second batch of eight quilts, then stops the quilting machine 11 at least by the time the eighth quilt of the second batch passes from the quilting head 23. This time the controller 29 informs the operator 50 on the display 49 that not only a pattern change from pattern B to pattern C is required and must be entered through the quilter control 25, but that one or more of the rolls of material 15, 17 or 19 must be changed. The material change usually involves a splice of the material upstream of the quilting head 23. When the operator 50 has changed the pattern and the material, the operator 50 signals that the change is complete and the controller 29.

Alternatively, material waste can be reduced by the controller 29 stopping the quilting machine 11 not when the last quilt of the second batch passes from the quilting head 23, but as the material needed for this last quilt reaches a splicing point, for example at a splicing head 61, upstream of the quilting head 23. Then, once a splice is made joining the leading edge of the material combination for the third batch to the trailing edge of the material combination for the second and first batches, the system 10 is restarted and run until the last quilt of the second batch has emerged from the quilting head 23, whereupon the system 10 is stopped for the making by the operator 50 of the pattern change of from pattern B to pattern C. Then the third batch of quilts is run.

When the system 10 is set up, the controller 29 is configured by loading information of the locations along the path of the web 12 and web 13 of the quilting head 23 and splicing head 61 relative to the panel cutter 30. This enables the controller 29 to accurately position the cuts made by the cutoff blade 34 relative to the patterns and the location of the cuts and patterns quilted by the quilting head 23 relative to splices made in the material with the splicing head 61.

The panel cutter 30 of the present invention converts a manual quilting system into an automated batch mode quilting line 10. In addition, the automated quilting system 10 can contain all of the programming and downloaded data that makes it capable of use as a fully automated quilting machine with the automated scheduling system 60 even though the system 10 uses a manual or only semi-automated quilting machine 11.

It is also a part of batch mode operations that the panel cutter will automatically, without operator intervention, cause side trimmer blades 62 to move to the appropriate position such that the correct horizontally measured size of the quilted material can be produced. This typically occurs at such times after that the controller 29 has signaled the cutter 34 to remove the small amount of web 13 that has inherently become waste due to a splicing operation prior to the quilting station 11. This waste can be an actual splicing of materials as indicated or a pattern change on the quilting station 11 with respect to the sewing components 23 that create the pattern shapes on the web 12. This small portion of web 13 removed due to this splice or change is commonly referred to as a "crop out". A "crop out" typically occurs between two separate and distinct products generally easily identifiable on the web 12 and 13 by the very nature of the splice(s) or change(s) involved. Upon this crop out phenomenon, the controller 29 is then programmatically tasked with making a decision, based on information typically assigned to it by the user 50 or the scheduling system 60, as to whether or not the position of the side trimmer blades 62 needs to be transversely adjusted. Based on this decision, the blades 62 are left in place or are driven by activating a trimmer positioning servo 63 with a signal on a control line 64 from the panel cutter controller 29, to their new position and this all prior to the panel cutter's 30 in-feed system 31 activating to move the next portion of the web 13 into position to be cut by the cross cutter 34.

From the above description of the preferred embodiments of the invention, it will be apparent to those skilled in the art that changes and additions to the method and apparatus can be made without departing from the principles of the present invention.

Accordingly, the following is claimed:

1. A quilting system panel cutter comprising:

a transverse cutoff mechanism mounted thereon that is operable to transversely sever a panel of quilted fabric from a web of quilted fabric in response to a cutoff signal;

feed elements operable to advance a leading edge of the web of quilted material through and beyond the cutoff mechanism;

a panel cutter controller operable to generate the cutoff signal in response to the feeding of a predetermined length of web of quilted material past the cutoff mechanism; and the panel cutter controller being operable to generate output signals containing information for controlling operations of a quilting machine having its own controls when such quilting machine is connected in-line with and upstream of the panel cutter and the information is communicated to controls of the quilting machine, to cause the quilting machine to supply quilted multilayered fabric downstream therefrom to the panel cutter, the panel cutter controller having an output connected to the quilting machine controls and the panel cutter controller being operative to generate an output signal to the quilting machine controls to cause the quilting machine to stop.

2. The panel cutter of claim 1 wherein:

the panel cutter controller is operable to receive information on the location of splices in the multilayered web of fabric and to generate the output signals containing information for controlling the operation of the cutoff mechanism to sever a length of fabric containing a splice from the web.

3. The panel cutter of claim 1 wherein:

the panel cutter controller is operable to generate the output signals for controlling the starting and stopping of the quilting machine.

4. A quilting system panel cutter comprising:

a transverse cutoff mechanism mounted thereon that is operable to transversely sever a panel of quilted fabric from a web of quilted fabric in response to a cutoff signal;

feed elements operable to advance a leading edge of the web of quilted material through and beyond the cutoff mechanism;

a panel cutter controller operable to generate the cutoff signal in response to the feeding of a predetermined length of web of quilted material past the cutoff mechanism; and the panel cutter controller being operable to generate output signals containing information for controlling operations of a quilting machine having its own controls when such quilting machine is connected in-line with and upstream of the panel cutter and the information is communicated to controls of the quilting machine, to cause the quilting machine to supply quilted multilayered fabric downstream therefrom to the panel cutter, the panel cutter controller being programmed to receive batch data defining a plurality of quilts to be manufactured of the multi-layered web of quilted fabric, and to generate the output signals to communicate control information for the operation of the quilting machine in the manufacture of a plurality of quilts defined by the batch data.

5. The panel cutter of claim 4 wherein:

the panel cutter controller is operable to receive information on the location of splices in the multilayered web of fabric and to generate the output signals containing information for controlling the operation of the cutoff mechanism to sever a length of fabric containing a splice from the web.

6. The panel cutter of claim 4 wherein:

the panel cutter controller is programmed to accept the input of scheduling commands and to generate the output signals to communicate control information for the operation of the quilting machine in the manufacture of a plurality of quilts defined by the batch data in accordance with a manufacturing schedule in response to input scheduling commands.

7. The panel cutter of claim 4 wherein:

the panel cutter controller has an input connectable to an automated scheduling system and is programmed to accept the input of scheduling commands downloaded from the automatic scheduling system and, in response thereto, to generate the output signals to communicate control information for the operation of the quilting machine in the manufacture of a plurality of quilts defined by the batch data in accordance with a manufacturing schedule in response to input scheduling commands.

8. The panel cutter of claim 4 wherein:

the panel cutter controller is programmed to receive batch data defining a plurality of quilts to be manufactured of different combinations of layers of material and to generate the output signals to communicate control information for the location of a splice to be made in the multilayered fabric being fed to the quilting machine to accommodate the quilts of the different combinations.

9. A quilting system comprising:

a panel cutter for use in a quilting line in combination with a quilting machine;

a quilting machine that is operable to quilt a specified pattern onto a multilayered web of fabric, and panel cutter comprising:

a transverse cutoff mechanism mounted thereon that is operable to transversely sever a panel of quilted fabric from a web of quilted fabric in response to a cutoff signal;

feed elements operable to advance a web of quilted material through and beyond the cutoff mechanism;

the quilting machine being in-line with and upstream of the panel cutter and having a quilting head operable to sequentially quilt a series of patterns along the multilayered web of fabric extending through the quilting machine;

a panel cutter controller operable to generate the cutoff signal in response to the feeding of a predetermined length of web of quilted material past the cutoff mechanism and to generate output signals containing information for controlling operations of the quilting machine;

feed elements supported at the quilting machine and positioned to driveably engage and longitudinally feed the quilted web of fabric downstream from the quilting machine to the panel cutter;

a longitudinal feed measuring device linked to the feed rolls and having an output connected to the panel cutter controller to communicate to the panel cutter controller a signal containing information of the length of quilted fabric being fed downstream from the quilting machine to the panel cutter; and the panel cutter controller being programmed to receive batch data defining a plurality of quilts to be manufactured of the multi-layered web of quilted fabric, and to generate the output signals to communicate control information for the operation of the quilting machine in the manufacture of a plurality of quilts defined by the batch data.

10. The panel cutter of claim 9 wherein:

the panel cutter controller is programmed to accept the input of scheduling commands and to generate the output signals to communicate control information for the operation of the quilting machine in the manufacture of a plurality of quilts defined by the batch data in accordance with a manufacturing schedule in response to input scheduling commands.

11. The panel cutter of claim 9 wherein:

the panel cutter controller has an input connectable to an automated scheduling system and is programmed to accept the input of scheduling commands downloaded from the automatic scheduling system and, in response thereto, to generate the output signals to communicate control information for the operation of the quilting machine in the manufacture of a plurality of quilts defined by the batch data in accordance with a manufacturing schedule in response to input scheduling commands.

12. The panel cutter of claim 9 wherein:

the panel cutter controller is programmed to receive batch data defining a plurality of quilts to be manufactured of different combinations of layers of material and to generate the output signals to communicate control information for the location of a splice to be made in the multilayered fabric being fed to the quilting machine to accommodate the quilts of the different combinations.

13. A method of providing batch mode capability to a quilting machine that is operable to quilt a pattern upon a multilayered web of fabric, the method comprising the steps of:

providing a panel cutter having a cutoff mechanism operable to sever a panel of quilted fabric from a web of quilted fabric from a quilting machine with a panel cutter controller operable to generate the cutoff signal in response to the feeding of a predetermined length of web of quilted material past the cutoff mechanism and operable to generate output signals containing information for the control of the operation of the quilting machine;

loading the panel cutter controller with manufacturing data of a plurality of quilts to be manufactured on the quilting machine;

connecting the panel cutter in-line with and downstream of the quilting machine to supply quilted multilayered fabric downstream to the panel cutter;

generating said output signals with the panel cutter controller in response to the operation of the panel cutter; and controlling the operation of the quilting machine in response to the output signals from the panel cutter controller to manufacture the plurality of quilts.

14. The method of claim 13 wherein:

the output signal generating step includes the step of communicating control signals to the quilting machine; and the controlling step includes the step of automatically stitching quilt patterns with the quilting machine in accordance with control signals from the panel cutter.

15. The method of claim 13 wherein:

the output signal generating step includes the step of displaying control information to an operator of the quilting machine; and the controlling step includes the step of manually controlling the quilting machine to stitch quilt patterns in accordance with control information displayed to the operator.

16. The method of claim 13 further comprising the steps of:

calculating with the panel cutter controller the amount of longitudinal shrinkage due to the quilting of fabric with the quilting machine; and adjusting the longitudinal quilting dimensions at the quilting machine in response to the calculated shrinkage.

17. The method of claim 13 further comprising the steps of:

loading scheduling information into the panel cutter controller specifying a schedule of a plurality of quilts to be quilted on the quilting machine; and operating the quilting machine in accordance with output signals from the panel cutter controller to produce the plurality of quilts in accordance with the schedule specified by the loaded scheduling information.

18. The method of claim 13 further comprising the steps of:

loading information into the panel cutter controller correlating each of a series of quilted products to be made on the quilting machine with layers of web material from which the quilted products are to be made; and controlling the quilting machine and splicing different webs of material in correlation therewith in response to output signals from the panel cutter controller.

19. The method of claim 13 further comprising the steps of:

starting and stopping the quilting machine in accordance with output signals from the panel cutter controller.

* * * * *

UNITED STATES PATENT AND TRADEMARK OFFICE

CERTIFICATE OF CORRECTION

PATENT NO. : 6,237,517 B1
DATED : May 29, 2001
INVENTOR(S) : Bondanza et al.

It is certified that error appears in the above-identified patent and that said Letters Patent is hereby corrected as shown below:

Title page,
Item [73], Assignee, please correct Assignee to read
-- L&P Property Management Company, South Gate, California. --.

Column 1,
Line 32, before "panel-length", delete "a".

Column 2,
Line 25, after "fabric", insert -- that --.

Column 3,
Line 20, before "panel-cutter", insert -- a --.
Line 25, after "control to", insert -- a --.

Column 5,
Line 29, delete "The quilting machine 11 at which stitched", and insert therefor -- At the quilting machine 11, stitched --.

Column 8,
Lines 53-54, after "extent", delete "that", and insert therefor -- of --.

Column 9,
Line 16, before "generated", delete "are", and insert therefor -- is --.

UNITED STATES PATENT AND TRADEMARK OFFICE

CERTIFICATE OF CORRECTION

PATENT NO. : 6,237,517 B1
DATED : May 29, 2001
INVENTOR(S) : Bondanza et al.

It is certified that error appears in the above-identified patent and that said Letters Patent is hereby corrected as shown below:

Column 10,
Line 2, after "using", delete "the".
Line 30, delete "and the controller 29".
Line 41, after "pattern change", delete "of".
Line 64, delete "after that", and insert therefor -- as after --.

Signed and Sealed this

Thirtieth Day of July, 2002

*Attest:*

*Attesting Officer*

JAMES E. ROGAN
*Director of the United States Patent and Trademark Office*